US006585044B2

(12) United States Patent
Rester et al.

(10) Patent No.: US 6,585,044 B2
(45) Date of Patent: Jul. 1, 2003

(54) METHOD, SYSTEM AND TOOL FOR RESERVOIR EVALUATION AND WELL TESTING DURING DRILLING OPERATIONS

(76) Inventors: Stephen Rester, Houston, TX (US); James L. Hunt, Katy, TX (US); Tim Wiemers, Houston, TX (US); Edgar Chacon, Al-Khobar (SA); John J. Baldauff, Katy, TX (US); Michael H. Johnson, Katy, TX (US); Rob L. Allen, Spring, TX (US)

( * ) Notice: Subject to any disclaimer, the term of this patent is extended or adjusted under 35 U.S.C. 154(b) by 35 days.

(21) Appl. No.: 09/842,488

(22) Filed: Apr. 25, 2001

(65) Prior Publication Data

US 2002/0134587 A1 Sep. 26, 2002

Related U.S. Application Data

(60) Provisional application No. 60/233,847, filed on Sep. 20, 2000.

(51) Int. Cl.[7] ..... E21B 47/00; G01T 5/08

(52) U.S. Cl. ..... 166/250.01; 166/252.5; 166/187; 250/254

(58) Field of Search ..... 166/250.01, 250.07, 166/250.08, 250.17, 187, 191, 252.5; 175/40, 48, 50, 230; 250/254, 257, 262, 264

(56) References Cited

U.S. PATENT DOCUMENTS

| | | | |
|---|---|---|---|
| 5,249,461 | A | 10/1993 | Ponder et al. |
| 5,317,111 | A | 5/1994 | Orban et al. |
| 5,551,287 | A | 9/1996 | Maute et al. |
| 6,051,973 | A | 4/2000 | Prammer |
| 6,057,784 | A | 5/2000 | Schaaf et al. |
| 6,167,348 | A | 12/2000 | Cannon |
| 6,176,323 | B1 | 1/2001 | Weirich et al. |
| 6,178,815 | B1 | 1/2001 | Felling et al. |
| 6,179,066 | B1 | 1/2001 | Nasr et al. |

OTHER PUBLICATIONS

SPE 38754, "Formation Testing While Underbalanced Drilling", Kardolus and van Kruijsdijk, Copyright 1997, 8 pgs.
SPE 54717, "Testing While Underbalanced Drilling: Horizontal Well Permeability Profiles", van Kruijsdijk and Cox, Copyright 1999, 9 pgs.
SPE 56684, "Inflow Predictions and Testing While Underbalanced Drilling", Larsen, Statoil and Nilsen, Copyright 1999, 7 pgs.
SPE 63141, "Applications of a New Multiple Sensor Production Logging System for Horizontal and Highly–Deviated Multiphase Producers", Chace, Wang, Mirzwinski, Maxit and Trcka, Copyright 2000, 14 pgs.
Cosse, R. "Basics of Reservoir Engineering", Gulf Publishing Co., Houston, Texas (1993).

(List continued on next page.)

*Primary Examiner*—Frank S. Tsay

(57) ABSTRACT

A novel method, system and tool for performing formation and well evaluation while drilling are disclosed. These inventions determine the properties of a particular formation within a reservoir as the reservoir is being intersected during well construction. In one form of the invention, the formation evaluation is made using a direct measurement of the formation's ability to flow fluids. The flow potential of a reservoir during underbalanced well construction is determined as the well is being constructed. The methods produce an understanding of the volumes and types of fluids such as oil, gas, and/or water, that can be produced out of discrete sections of a formation within a reservoir as the reservoir is intersected. The trajectory and path of the wellbore through the reservoir are modified to intersect formation having more desirable permeability and productivity to decrease the time to market of the hydrocarbon reserves within a reservoir without the time delay inherent when conventional formation evaluation techniques are applied. A downhole flow measurement instrument is used to obtain actual flow ratios. The instrument is integrated into a near-bit stabilizer and can be used for early kick and benign "breathing" fractures detection in the open hole wellbore.

91 Claims, 3 Drawing Sheets

OTHER PUBLICATIONS

Bourdarot, G. "Well Testing: Interpretation Methods", Editions Technip, Paris (1998).

"Underbalanced Drilling Manual" Gas Research Institute, Chicago, IL (1997).

Hunt, James L. and Rester, Stephen "Reservoir Characterization During Underbalanced Drilling: A New Model" Society of Petroleum Engineers #59743.

Christel Kardolus "Testing While Underbalanced Drilling" Delft University of Technology, Faculty of Applied Earth Sciences, Section Reservoir Engineering, Jul. 1997.

Richard J.W. Cox "Testing Horizontal Wells While Drilling Underbalanced" Delft University of Technology, Faculty of Applied Earth Sciences, Section Reservoir Engineering, Aug. 1998.

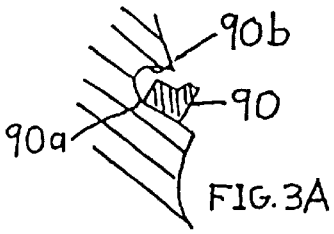
FIG. 3A
Figure 3
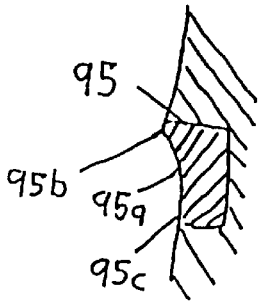
FIG. 3B
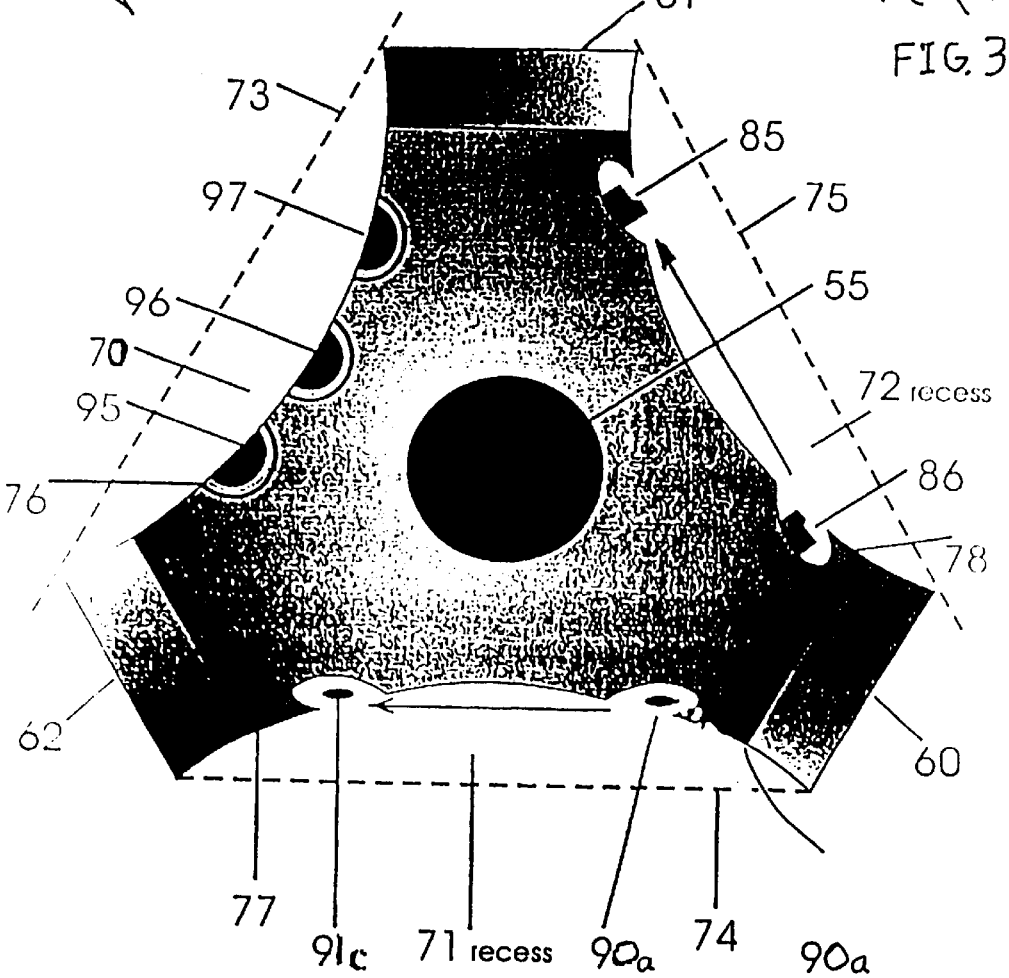

METHOD, SYSTEM AND TOOL FOR RESERVOIR EVALUATION AND WELL TESTING DURING DRILLING OPERATIONS

REFERENCE TO RELATED PATENT APPLICATIONS

This application claims priority from U.S. provisional application serial No. 60/233,847 filed Sep. 20, 2000.

FIELD OF THE INVENTION

The present invention relates generally to testing and evaluating a section of reservoir intersected during the well construction process. More particularly, the present invention relates to methods, systems and tools used in testing and evaluation of a subsurface well formation during drilling of the wellbore.

SETTING OF THE INVENTION

A reservoir is formed of one or more subsurface rock formations containing a liquid and/or gaseous hydrocarbon. The reservoir rock is porous and permeable. The degree of porosity relates to the volume of liquid contained within the reservoir. The permeability relates to the reservoir fluids' ability to move through the rock and be recovered for sale. A reservoir is an invisible, complex physical system that must be understood in order to determine the value of the contained hydrocarbons.

The characteristics of a reservoir are extrapolated from the small portion of a formation exposed during the well drilling and construction process. It is particularly important to obtain an evaluation of the quality of rock (formation) intersected during well construction. Even though a large body of data may have been compiled regarding the characteristics of a specific reservoir, it is important to understand the characteristics of the rock intersected by a specific wellbore and to recognize, as soon as possible during the process of well construction, the effective permeability and permeability differences of the formation intersected during well construction.

The present invention is primarily directed to wellbore and formation evaluation while drilling "underbalanced." Underbalanced drilling is a well construction process defined as a state in which the pressure induced by the weight of the drilling fluid (hydrostatic pressure) is less than the actual pressure within the pore spaces of the reservoir rock (formation pressure). In a more conventional process, the well is typically drilled "overbalanced." In an overbalanced drilling process, the pressure induced by the weight of the drilling fluid (hydrostatic pressure) is greater than the actual pore pressure of the reservoir rock.

During underbalanced well construction, the fluids within the pore spaces of the reservoir rock flow into the wellbore. Because flow is allowed to enter the wellbore, the fluid flow characteristics of the formation are more easily observed and measured. During overbalanced drilling, the drilling fluid may enter the formation from the wellbore. While this overbalanced flow may be evaluated to assess formation properties, it is more difficult to quantify fluid losses to the formation then it is to quantify fluid gains from the formation.

There are significant benefits obtained from the application of underbalanced well construction techniques. The rate of penetration or speed of well construction is increased. The incidence of drill pipe sticking is decreased. Underbalanced operations prevent the loss of expensive drilling fluids.

An understanding of the reservoir being penetrated during the well construction process requires direct and indirect analysis of the information obtained in and from the well. Core analysis and pressure, volume, temperature (PVT) analyses of the reservoir fluids are measurements and testing performed in a laboratory after the wellbore has been drilled. This process of formation evaluating is both costly and time-consuming. Also, it is not practical to perform core analysis and PVT studies on every well constructed within a reservoir.

During drilling of a wellbore, important information can be determined by evaluating the fluids flowing to the well surface from the formation penetrated by the wellbore. The amount of gas included in the surface flow is particularly important in evaluating the formation producing the gas. The volume of gas per unit of time, or flow rate, is a critical parameter. The rate of gas flow from the formation is affected by the back-pressure exerted through the wellbore. The information desired for a particular formation or layer is the flow rate capacity during expected flowing production pressure. The best measure of this flow rate occurs at the flowing production pressure, however, conventional gas flow measuring instruments require flow restricting orifices in performing flow measurements. Instruments using differential orifices as the basis for flow management are accurate only within a relatively narrow range of flow. Sporadic flow changes associated with penetration of different pressured or flowing formations can produce flow rates outside the accuracy limits of the measuring instrument. Surface measurements of gas flow are, consequently, performed at pressures that are different from normal flowing pressures and the results do not accurately indicate the gas flow potential of the formation. The procedures commonly employed to measure surface flow during drilling or constructing a well that restrict the flow as a part of the gas flow rate measurement reduce the accuracy of evaluations of formation capacity based upon such measurements. Conventional instruments that measure flow without restricting the flow are typically incapable of making precise measurements. These instruments, which generally use a Venturi tube in the flow line, produce unduly broad indications of flow rates.

Indirect analysis of information requires reference to well logs that are recorded during well construction. A well log is a recording, usually continuous, of a characteristic of a formation intersected by a borehole during the well construction process. Generally, well logs are utilized to distinguish lithology, porosity, and saturations of water oil and gas within the formation. Permeability values for the formation are not obtained in typical indirect analysis. An instrument for repeated formation tests (RFT) also exists. The RFT instrument can indicate potentially provided permeability within an order of magnitude of correctness. Well logging can account for as much as 5 to 15 percent of the total well construction cost.

Another means of formation testing and evaluation is the process of drill stem testing. Drill stem testing requires the stopping of the drilling process, logging to identify possible reservoirs that may have been intersected, isolating each formation of each intersected reservoir with packers and flowing each formation in an effort to determine the flow potential of the individual formation. Drill stem testing can be very time consuming and the analysis is often indeterminate or incomplete. Generally, during drill string testing, the packers are set and reset to isolate each reservoir intersected. This may lead to equipment failures or a failure to accurately obtain information about a specific formation.

Because each formation is tested as a whole, the values or data obtained provide an average formation value. Discrete characteristics within the formation must be obtained in another manner. The discrete characteristics within a layer of the formation are generally inferred from traditional well logging techniques and/or from core analysis. Well logging and core analyses are expensive and time-consuming. The extensive time involved in determining the permeability (productability) of each intersected reservoir layer in a wellbore through multiple packer movements and multiple flow and pressure buildup measurements required during a drill stem test make the process expensive and undesirable.

SUMMARY OF THE INVENTION

It is the primary object of the present invention to provide a method, system and tool for obtaining information about a formation while constructing a wellbore designed to intersect the formation. One characteristic of the formation that determines the productability of the well is permeability. During production, the fluid flows through the medium of the reservoir rock pores with greater or lesser difficulty, depending on the characteristics of the porous medium. The parameter of "permeability" is a manager used to describe the ability of the rock to allow a fluid to flow through its pores. Permeability is expressed as an area. However, the customary unit of permeability is the millidarcy, 1 mD=$0.987\times10^{-15}$ $m^2$. Permeability is related to geometric shape of flow passages, flow rate, differential pressure, and fluid viscosity.

Parameters such as bottomhole temperature and pressure are acquired through a bottomhole assembly during actual drilling operations and the acquired values are transmitted to the surface.

In the first method of the invention, the drilling assembly drills the wellbore to a point above the formation of interest. The measuring instruments in subsurface instruments carried by the drilling assembly are calibrated with surface measuring instruments at the well surface. The calibration is performed by evaluating injected and return fluids circulated through the closed flow system provided by the drill string assembly and the wellbore annulus. Precise qualitative and quantitative measuring instruments are provided in the calibrated system to produce accurate measurements of fluid composition, flow rates, volumes and condition of fluids injected into the drill string from the surface and fluids returning in the annulus from both the drill string and the formation.

An important feature of the present invention is the use of an ultrasonic gas flow meter in the surface measurements of gas being produced from the formation to permit unrestricted flow measurements that accurately reflect the formation's flow characteristics. A chromatograph is used in the surface measurements of annular fluid flow to precisely identify constituents of the flow. The results of the measurement assist in making well construction decisions as the well is being drilled.

A second method of the present invention utilizes a downhole device to obtain downhole flow rates. These downhole flow rates can be compared to the flow rates determined from well surface operations. The direct measurement of downhole flow permits a more accurate permeability calculation on a foot-by-foot basis of the wellbore penetration through the formation. The need for a complex mathematical model to convert surface rates and flow properties to downhole conditions is eliminated when accurate bottomhole flow rates are obtained with a directly measuring tool.

In the methods of the invention, the bottomhole temperature and pressure may be used to determine density and/or viscosity of the produced fluids. To determine initial reservoir pressure, the drilling operation may be stopped and the well shut in to allow the pressure to buildup. Additionally, a series of flows at different differential pressure may be used to extrapolate to the initial reservoir pressure. Using these parameters, an effective permeability can be calculated for the section of formation contributing to the flow.

The measured parameters at the bit are transmitted to the well surface using fluid pulse telemetry or other suitable means. Generally, the downhole data transmission rate, relative to the rate of penetration in a reservoir, is such that the data acquisition at the bit downhole or at the surface is considered to be "real-time" data.

Another means of obtaining the necessary data for these novel methods of formation evaluation is to have the downhole measurements taken and stored in a subsurface memory device during actual well construction operations. After the data is acquired and stored in the memory device, it may be retrieved at a later time such as during the replacement of a worn out drill bit. This recorded data is considered "near real-time" because it is not transmitted to the surface from downhole. This near real-time data from downhole is synchronized and merged with either surface measurements of hydrocarbon production or downhole measurements from the subsurface measurement instrument and used to compute the permeability and productivity of the formation intersected during the well construction process. Near real-time methods are utilized when the added expense of real-time is not warranted. The choice is usually based upon required placement accuracy of the wellbore, or when the real-time transmission is technically not feasible, or when the general economics of the reservoir prohibit use of real-time methodology.

A novel downhole flow measuring tool comprises a part of the present invention.

The downhole tool connects between the drill string and bit. Blades on the tool provide external longitudinal recesses that channel fluid across transducers mounted on the blades. The tool structure functions as a drilling stabilizer and, while rotating, positively directs the well fluid into the fluid recesses where various transducers carried by the tool are used to assist in determining flow rate and other parameters of the well fluid. This latter feature is particularly useful in horizontal drilling application where the well fluids may tend to stratify vertically.

In the preferred embodiment of the tool, several types of transducers are deployed along the tool's external surface to provide a large number of different well fluid measurements. The increased number of measurements permits significant improvement in the accuracy of the flow rate measurements and other measurements made by the tool.

BRIEF DESCRIPTION OF THE DRAWINGS

FIG. 3 is a partial cross section taken along the line 2—2 of FIG. 1 illustrating the placement of three different types of energy transducers or sensors integrated into the drilling stabilizer of FIG. 1;

FIG. 3A is an enlarged view of a focusing notch employed with the induction transmitters of the present invention; and FIG. 3B is an enlarged view of illustrating details in the construction of the capacitance transducers of the present invention.

DETAILED DESCRIPTION OF THE ILLUSTRATED EMBODIMENTS

Figure 1:
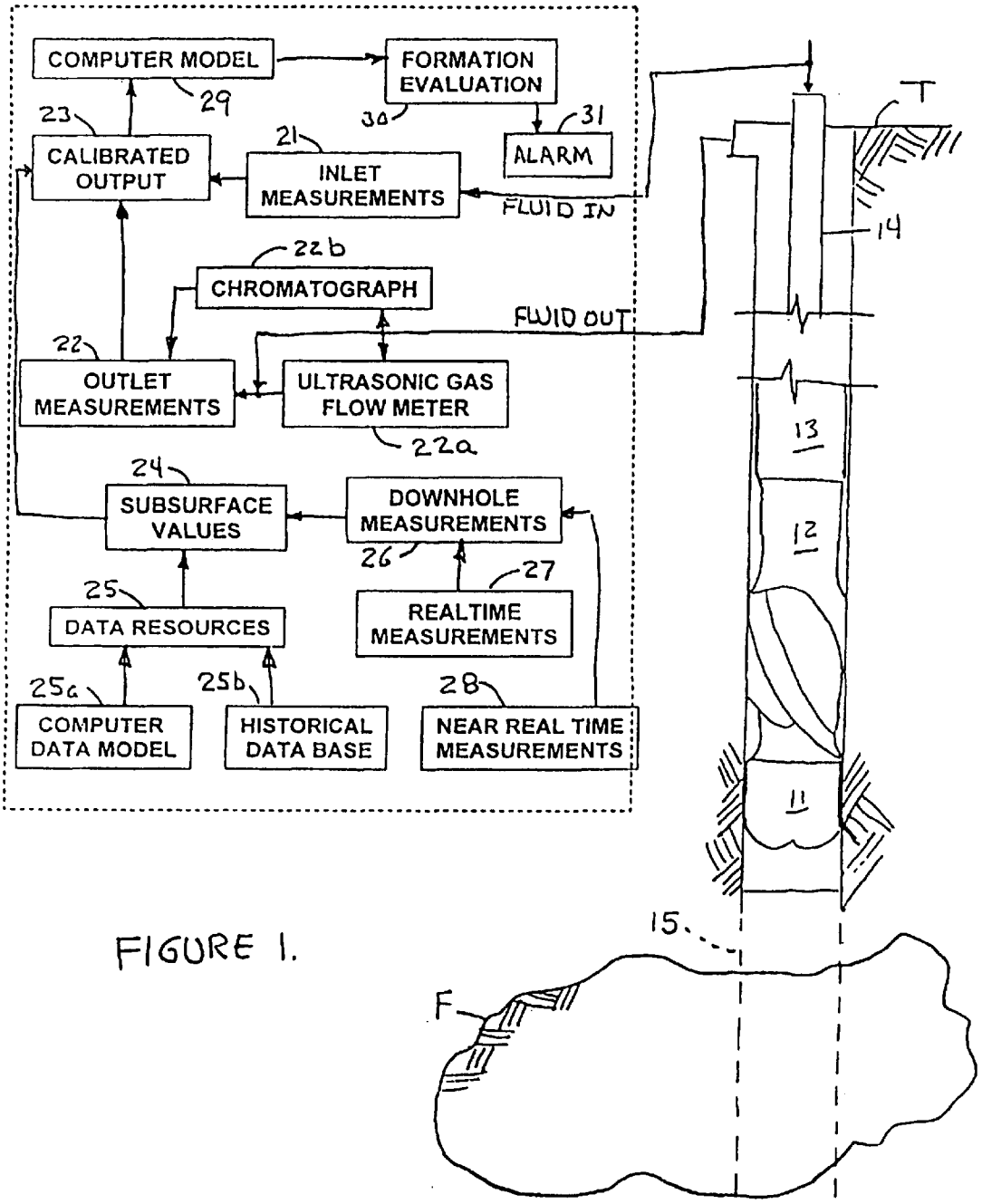
FIG. 1 is a schematic illustration of a system of the present invention used to evaluate a subsurface formation being intersected by a wellbore during well construction.

FIG. 1 illustrates a system of the present invention indicated generally at 10. The system 10 is employed to determine the permeability of a formation F that is to be penetrated by a wellbore B. A drilling assembly comprising a bit 11, drilling stabilizer 12, subsurface measuring and recording instrument 13 and drill string 14 extend from the wellbore B to the wellbore surface T. Only a portion of the bottomhole assembly is illustrated in FIG. 1. The projected wellbore trajectory is indicated by a dotted line section 15.

A measuring system 20 used in the evaluation of a formation F is equipped with an inlet fluid measuring section 21, an outlet measurement section 22 and a calibrated instrument analysis section 23. The measuring system 20 measures and evaluates the fluids flowing into the wellbore B through the drill string 14 and measures and evaluates the fluids returning to the top or surface of the wellbore T through an annulus A formed between the drill string and the wellbore. As used herein, reference to measuring or evaluating "flow" of a fluid is intended to include measurement or evaluation of characteristics of the fluid such as temperature, pressure, resistivity, density, composition, volume, rate of flow and other variable characteristics or parameters of the fluid.

The calibrated analysis section 23 may be supplemented with subsurface parameter values obtained from a subsurface values section 24. The data from the section 24 are delivered from either a data resource 25 or from an actual downhole measurements section 26. Data provided by the data resource section 25 may be data taken from historical data sources 25*a,* such as analogous or similar wells or the data may be derived from a computer data model 25*b* that performs mathematical calculations, or determines data from other inferential processes. The actual downhole measurements are provided through a real-time system section 27 or a near real-time system section 28.

In applying the method of the present invention to a system in which subsurface flow values are to be inferred or deduced from measurements or assumed values of related parameters, the system 20 is calibrated and checked before the wellbore B is extended into the formation F. This step in the procedure assists in determining system noise and in determining circulating system responses to changes in the back-pressure in the annulus A.

The system calibration process and checking are preferably performed between 5 and 25 meters above the anticipated top of the formation F. The top of the formation F may be determined using a geological marker from an offset well, seismic data or reservoir contour mapping. During the calibration process, a closed fluid flow system is established by the drilling assembly in the wellbore B such that fluids introduced into the drill string 14 travel through the drilling assembly 14, 13, 12, 11, and exit the drilling assembly through the bit 11 where they are returned to the well surface T through the annulus A. Only fluids introduced into the drill string 14 flow through the closed system during the calibration and checking process.

The calibration performed by circulating a known quantity and density of a known fluid (gases included) while the drilling assembly and any downhole sensing equipment carried in the drilling assembly are deployed within the wellbore B. A material balance relating the injected fluids to the returned fluids is preferably employed in the calibration process. The calibration process is employed to establish a standard or control to detect or determine changes in measurements that result from encountering a productive formation environment.

In a preferred method of calibration, the following parameters are measured for a minimum of three different back-pressure values obtained at the annulus A while fluids are circulating through the system:

I) injection: pressures, temperatures and rates;

II) bottomhole: annulus pressures and temperatures;

III) return: pressures, temperatures and rates; and

IV) C1 to C6 hydrocarbon percentage over a period of 1.1 to 15 wellbore circulation volumes.

The time required for the fluid to complete circulation through the drilling assembly and return to the surface through the annulus is monitored and recorded. In a preferred method, a circulation time measurement is performed with the assistance of a tracer added to the injection fluid stream entering the drill pipe 11 at the well surface T. The elapsed time from injection of the tracer until reappearance of the tracer in the fluid returns at the well surface annulus indicates the circulation time. The tracer material may be a carbide, or an inert substance such as neon gas, or a short half-life radioactive material or other suitable material.

After calibration and system checking are performed, the drilling operation is resumed and the drilling assembly is used to extend the wellbore into the formation F. During extension of the wellbore, the rate of penetration is preferably maintained at a rate below 25 meters per hour. The weight on bit and rotary or bit motor speeds are maintained as constant as possible to enhance the accuracy of the results of the system measurements.

In performing the method of the present invention during underbalanced drilling conditions, it is preferable to maintain an underbalanced bottomhole pressure between 100 and 2000 psi below the anticipated pressure of the formation F. The bottomhole pressure can be adjusted by manipulation of the drilling fluid densities, pump rates and annular back-pressures.

The point at which the drill bit 11 encounters the top of the formation F may be determined by closely monitoring the system 20 for any significant change in the bottomhole pressure, bottomhole temperature, C1 or surface flow rates. Once the top of the formation F has been traversed, an additional 1 to 5 meters of wellbore depth is drilled into the formation and the drilling is stopped as fluid circulation is maintained.

In an underbalanced condition, reservoir flow and pressure response are established while injecting fluid into the drill string 14 from the surface and combining the injected fluids with fluids flowing from the reservoir F into the wellbore B. The combined injection and formation fluids flow through the annulus A to the well surface T. During this step, the following sensor point measurements are performed:

I) injection: pressures, temperatures and rates;

II) bottomhole: annulus pressures and temperatures;

III) return: pressures, temperatures and rates; and

IV) C1 to C6 hydrocarbon percentage over a period of 1.1 to 15 wellbore circulation volumes.

The measurements I)–IV) are made and recorded for a preferred period of time equivalent to 1.5 to 15 times the "bottoms up" time. "Bottoms up" time is the time required to flow fluid at the bottom of the wellbore to the well surface.

Once a stabilized annular flow through the annulus A has been established, the back-pressure in the annulus is increased to achieve a second underbalanced flowing condition. If the annular flow does not stabilize at this increased back-pressure, the back-pressure is reduced by 25 percent and the annular flow is maintained for 1.5 to 15 times the bottoms up time to test for stabilization of the annular flow.

The next step in the method is to reduce the circulating back-pressure or bottomhole pressure by 30 to 40 percent, preferably not to exceed 35 percent of the draw down on the bottomhole pressure (BHP) for a period of time of from 1.5 to 15 times the bottoms up time, depending on the annular flow conditions. The time of each back-pressure change is recorded, to be correlated with the flow measurements. The back-pressure is increased, using either a surface choke or by increasing the bottomhole pressure, to a safe drilling level and then stabilized over a period of from 1.5 to 15 times the bottoms up time.

Drilling is resumed and the borehole B is extended to the formation F at a steady drilling rate of preferably 10–20 meters per hour. During the resumption of drilling, the sensor points variable measurements I)–IV) are continuously monitored and recorded. Drilling is continued until the formation F has been fully traversed. Once the wellbore extends below the bottom of the formation by 2 to 10 meters, drilling is stopped. Fluid flow through the annulus is continued for a time of from 2 to 15 times the bottoms up time. If the back-pressure in the annulus A cannot be increased without killing the well, the annulus back-pressure is decreased by 15–20 percent from the initial pressure value occurring following initial penetration of the formation bottom. If the back-pressure in the annulus A is still high enough to kill the well, the annulus back-pressure is decreased 30–40 percent from the initial pressure value.

Once the measurements have been completed following the application of the different back-pressures in the annulus A, the original back-pressure existing at the penetration of formation bottom is restored and the wellbore drilling is continued, or the drilling assembly is pulled from the well if the total well depth has been reached.

The flow rates and corresponding bottomhole pressures obtained from the foregoing process are plotted to form Inflow Production (IPR) curves. The IPR curves are extrapolated to determine the virgin reservoir pressure P* of the formation F or a specific portion of the formation or layer of interest. This method is an alternative technique for determining the formation pressure P* without using direct measurement process of stopping circulating through the well, shutting in the well and then allowing the pressure from the formation to build up to a stabilized level indicative of P*.

With the collected data, Darcy's Radial Flow equation is used to solve for matrix permeability "k,". or fracture transmissibility "kh." Skin effect S is assumed to be zero where underbalanced drilling conditions are used since the absence of drilling fluid flow into the formation exerts minimal skin damage to the formation. P* is taken from the IPR curves or shut in pressure buildup determination. These calculations can conveniently be used to provide a graphical presentation of flow rate versus drilling depth.

Evaluation of the formation F using the measurements and data obtained in the described process may be enhanced with the use of a computer model 29 of the reservoir. The computer model can account for variances attributable to multiple formation layers, partial penetration of a zone, dual porosity of the formation and the occurrence of vertical, horizontal or high angle wellbores as well as other variations in parameters. The computer model may be employed to more accurately project well production and reserve estimates. Presentation of the evaluation and activation of alarms is made by an evaluation section 30. A kick alarm 31 provides early warning of an influx of formation fluids into the wellbore.

The methods of the present invention may also be practiced in a system using data obtained directly with downhole flow measurement instruments that comprise a part of the drilling assembly. In a directly measuring downhole system, the requirement for initial system calibration is reduced or becomes unnecessary. With the exception of the initial calibration step, the steps used in performance of the method when using direct downhole flow measurement instruments are substantially the same as those employed when downhole flow parameters are determined inferentially or are obtained from indirect measurements or a data resource. Using actually determined subsurface flow measurements eliminates the requirement for the computer model 29 or the data model 25*b* and otherwise reduces the need for extensive mathematical correlations and calculations to obtain accurate formation values. Direct measurements also enable rapid warning of a kick to initiate an alarm from the measuring component 31.

Figure 2:
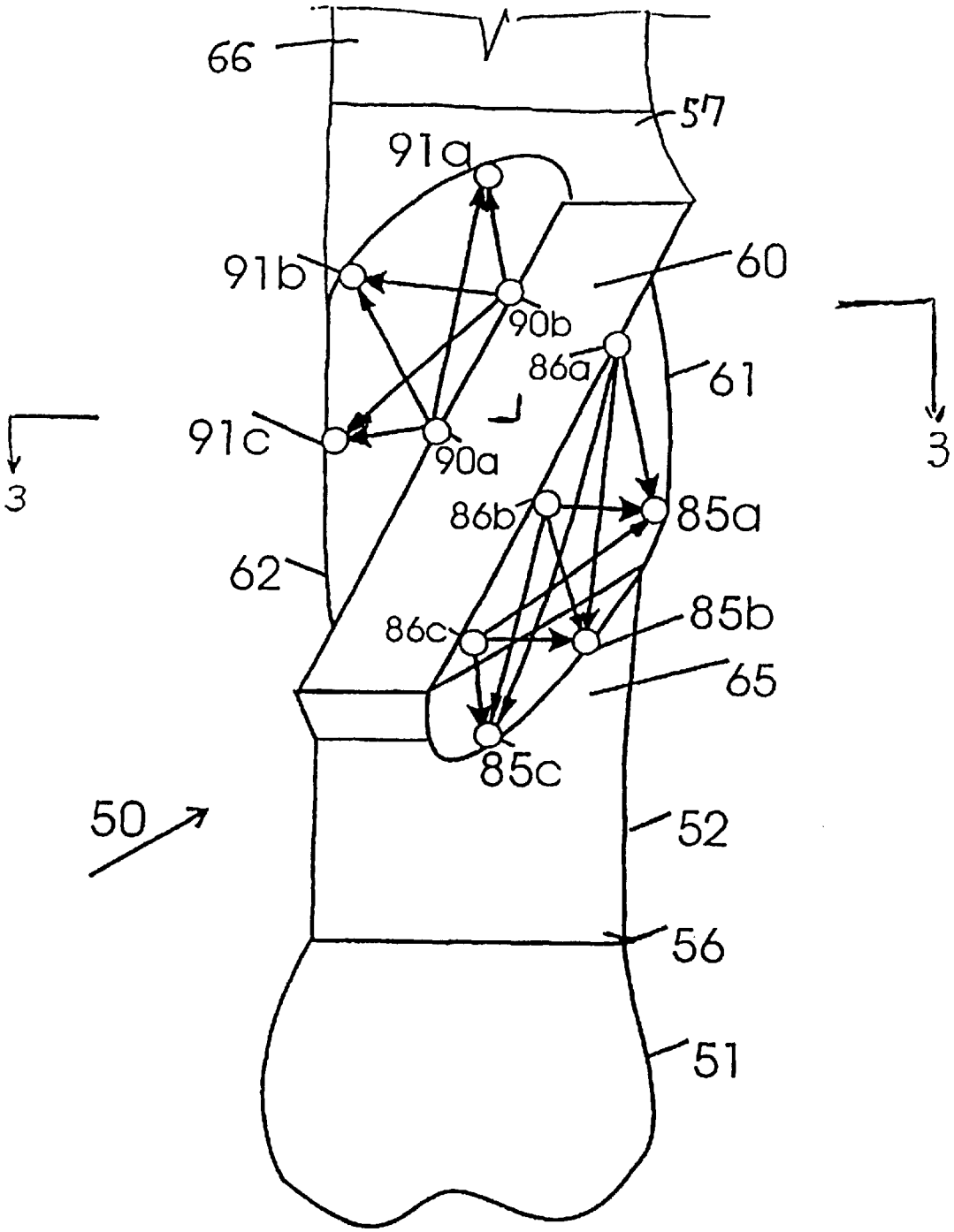
FIG. 2 is an elevation of an integral blade stabilizer body having energy measurement transducers used for subsurface measurements while drilling.

FIGS. 2 and 3 illustrate details in a preferred subsurface measurement tool, indicated generally at 50, for assisting in determining permeability of the formation F. The measurement tool 50 is illustrated connected to a drill bit 51 to function as part of a near-bit stabilizer. It will be appreciated that the tool 50 may be employed at other near-bit locations within a bottomhole drilling assembly and need not necessarily be connected immediately to the bit, the objective being to provide a stabilizing relationship between the bit and the tool 50. The instrument tool 50 includes three separate types of detection devices in the vicinity of the drill bit permitting a large number of combinations of signals to be analyzed thereby producing increased flexibility and accuracy in both measurement while drilling (MWD) and formation analysis operations.

The instrument tool 50 is equipped with an axially extending body 52 having a central, axially developed passage 55 for conveying fluid between a first axial tool end 56 and a second axial tool end 57. Radially and axially extending, circumferentially spaced blades 60, 61 and 62 extend from an external tool surface 65. The instrument tool 50 is connected at its first end 56 to a bit 51 and at its second axial end 57 to a monitoring and recording tool 66 that processes and records the measurements taken by the instrument tool 50. The tool 66 records and/or transmits measurements to the well surface. Recorded measurements are retained in the recorded memory until the drilling assembly is retrieved to the well surface or the measurements may be transmitted to the surface through fluid pulse telemetry or other suitable communication means.

The tools 50 and 66 are connected with the measuring system 20 for real-time or near real-time measurements that permit formation evaluation. Analog to digital converters in the measuring system 20 process signals detected at the transducer receivers and capacitive energy transducers and supply numerical representations to a microprocessor system within the components 23, 29 and 30. The measuring system 20 of the present invention employs a microprocessor and digital-to-analog converters to enable the production of many different types of signals with the acoustic transducers or electromagnetic antenna systems. Both high and low frequency signals can be created. In addition, fast rise time and slow fall time "saw tooth" signals may be employed to provide specific, more discrete rates of change in electronic signaling as compared to older techniques employing continuous variations of sine waves.

The output signals from the energy transducers employed in the present invention are calibrated and the programming employed in the measuring system is modified to counter intrinsic tool inductance and capacitance that would normally distort the output signals. Reduction in distortion and the presence of discreetly rising and falling signals contribute to greater accuracy in the measurement of the inductance of the fluids. Broad variations in times of signal changes are employed to cause attenuations or reinforcements of signals depending upon gas bubble sizes or oil droplet diameters and volumes. The combinations of frequencies ranging from high to low, and varying rates of change within signals assist in sorting smaller and larger bubbles and globules. The dimensions of water concentrations between other fluid contacts also alters the broad range of signals in different ways. Significant fluid geometry information is extractable from the many signals being altered by the flowing fluids and then detected at the receivers of the present invention.

As best illustrated in FIG. 3, several fluid receiving recesses 70, 71 and 72 are defined between the circumferentially spaced blades in an area intermediate the external surface 65 of the tool body and the wellbore wall (not illustrated). The recesses 70, 71 and 72 are illustrated in FIG. 3 between dotted lines 73, 74 and 75, respectively, and external tool surfaces 76, 77 and 78, respectively, of the tool 50.

The primary monitored indicator of flow in the recesses 70, 71 and 72 is preferably a marker comprising a bubble of gas or a gaseous cluster entrained within the liquid flowing through the recess being monitored. The electrical sensors, circuitry and analytical process for correlating the measurements taken by the various transducers determine a rate of movement of the bubble marker past the transducers.

Energy transducers are carried by the blades for evaluating characteristics of fluid contained in the fluid receiving recesses. The measured characteristics are convertible into a measure of the flow rate of the fluid flowing through the recesses. To this end, acoustic transducer receivers 85 and acoustic transducer transmitters 86 are carried in the blades 61 and 60, respectively. Electromagnetic induction transmitting transducers 90 and electromagnetic receiving transducers 91 are carried in the blade 60 and 62, respectively. Electrical capacitance transducers 95, 96 and 97 are carried on the tool body between the blades 62 and 61.

Referring to FIG. 2, the energy transducers carried by the tool 50 are deployed at axially spaced locations along the tool body 65 and blades 60, 61 and 62 to enable the transducers to detect variable parameters associated with axial movement of fluid flowing through the recesses with which the transducers are associated. Accordingly, three acoustic receivers 85*a*, 85*b* and 85*c* are deployed at axially spaced locations along the blade 61 and three acoustic transducer transmitters 86*a*, 86*b* and 86*c* are deployed at axially spaced locations along the blade 60. Similarly, two electromagnetic transmitters 90*a* and 90*b* are axially deployed along the blade 60 and three electromagnetic receivers 91*a*, 91*b* and 91*c* are axially deployed along the blade 62. Capacitive transducers are also deployed at circumferentially and axially spaced locations along the body of the tool 50. Capacitive transducers 95, 96 and 97 are displayed in FIG. 3 at only one axial location. Similar arrays of capacitive transducers (not illustrated) are deployed at other axially spaced locations between the blades 61 and 62. The various transmitters, receivers and capacitance energy transducers are preferably located high within the protected areas between the stabilizer blades to avoid the mud and rock cuttings that often accumulate in greatest qualities on the lower portions of the blades. The blades function to form fluid channeling recesses to confine the fluid being monitored and also provide protective structure for the energy transmitters.

With reference to the detail drawing of the transducer 90 in the induction transmitting antennas of the transducers 90 are positioned within notches in the blade 62 that have curved shapes with sloping surfaces 90*b* that slightly increase from a parabolic shape to produce an over focusing from a parallel beam to a concentrated point at the receiving transducers 91. Over focusing of the transmitter signal counteracts dispersion caused by bubbles and rock cuttings in the fluid flowing past the sensors. The angles between the transmitters and receivers are preferably optimized for vector processing relating to typical rotation speeds and expected fluid velocities.

As illustrated in the detail drawing of transducer 95, illustrated in FIG. 3B, the capacitance transducers 95, 96 and 97 are preferably provided with concave surface electrode shapes 95*a* to improve contact with the convex surfaces of bubbles or rounded oil globules entrained within the fluid flowing past the transducers. Gas bubble shapes change sizes as a function of changing depth and pressure within the wellbore. The capacitance transducers preferably protrude slightly radially from the body of the tool body 50 with the concave surface shapes having an increasing curvature toward the top 95*b* of the tool 50 to permit better contact of the surface with both small and larger bubbles. The larger curvature at the top of the transducers permits improved matching of shapes of the smaller bubbles or oil globules with the transducers. The smaller curvature at the bottom 95*a* of the transducers forms a better match with the external surfaces of larger bubbles or globules.

In operation, the acoustic and electromagnetic transducers in the tool 50 and associated instruments in the recording tool 66 monitor the characteristics of the fluid intercepted in the travel paths of the energy signals traveling between transducers. The capacitive transducers monitor the characteristics of the fluid engaging the reactive surfaces of the transducers. Each of the three acoustic transmitters communicate with each of the three acoustic receivers to produced nine transmission paths. The paths are identified as a function of their physical position within the fluid receiving recess. The electromagnetic transducers function similarly to produce a total of six transmission paths. The radial and axial displacement of transducer paths produces an array of readings that can be correlated both in time and location to provide the rate of flow of fluids flowing through the fluid receiving recesses. The change in capacitance along the axial distribution of the capacitive transducers provides a measure of the flow past the monitoring surfaces.

The measuring process performed by the tool 50 is preferably done while the tool is rotating with the bit in the wellbore. The rotating motion of the tool homogenizes the liquid and gases into a uniform mixture that enhances the detection capabilities of the sensors. Rotation of the tool 50 also permits each set of three detection systems to provide full borehole coverage. The blades of the tool protect the measuring devices from impact with borehole walls and also afford protection from impact with solids in the returning well fluids.

Rotation of the tool produces centrifuging of certain fluids that enter the fluid receiving recesses of the tool. Gas, oil and water are inclined to be differentially concentrated by centrifuging. As a result, methane and other gases may be more easily detected as they are concentrated within the receiving recesses by the spinning motion, pushing denser liquids to the outer edges of the blades. The spinning of the tool also significantly reduces segregation of fluids with respected to the top or bottom side of an inclined wellbore. Mixtures of liquids commonly encountered in well drilling produce complex combinations of signal frequencies and signal wavelet shapes transmitted from acoustic and reactive sources to detectors. Analysis of the transmitted signals provides numerous data sets for physically evaluating a slurry having variations in mixing rules or properties.

The tool 50 may be used as a kick detector during the construction of the well. The tool's kick detection capability stems from its ability to recognize changes in the subsurface wellbore conditions and fluids associated with a kick. Subsurface detection of increased flow rate or other variables can give an early kick warning. If a wellbore influx or kick occurs during drilling, the presence of oil bubbles in the fluid flowing through the recess 72 will slow acoustic travel times between the acoustic sensors 85*a*, 85*b*, 85*c* and 86*a*, 86*b*, 86*c*. Gas bubbles in the recess 72 will cause far greater increases in acoustic travel time between the energy transducers significant acoustic wave amplitude attenuations will also occur upon the influx of oil or gas into the recess 72. Wave shapes of acoustic signals will be distorted or exhibit complex interference and dielectric measurements will deviate from drilling mud readings. A predetermined combination of the described sensor readings causes the software or firmware in the measurement section 30 to alter mud pulsing priorities and send warnings to the surface kick detection component 31.

Gas or oil bubbles passing up past the bit during a trip out of the hole are detected by leaving the power on to the induction and acoustic monitoring systems included in the tool 50. Since mud pulses are not being relayed during tripping, a warning system as relayed to the drilling crew by changing acoustic pulses to a gas detection indication sequence. A stethoscope type or amplified sound detection and filtering system in the component 31 enables a crewman to hear a kick warning pulse pattern (e.g., SOS) during a brief quiet period (block lowering time) between pulling each stand.

The tool 50 may also be used to indicate early wellbore stability problems. Faster acoustic travel times, some resistivity changes, and some dielectric changes can indicate increases in quantities of rock cuttings. Mud velocity reductions or other actions may be taken to reduce excessive "washing out" or widening of the borehole after increased cuttings volumes from weaker formations are detected.

It will be appreciated that various modifications can be made in the design, construction and operation of the present invention without departing from the spirit or scope of such invention. Thus, while the principal preferred construction and mode of operation of the invention have been explained in what is now considered to represent its best embodiments, which have been illustrated and described herein, it will be understood that within the scope of the appended Claims, the invention may be practiced otherwise than as specifically illustrated and described.

What is claimed is:

1. A method for evaluating a formation characteristic in a well having a wellbore for intersecting a subsurface formation and being drilled from a wellbore surface with a drill bit carried at the end of a drill string, comprising:

establishing a measuring system having measuring instruments for measuring a fluid flowing into and out of said wellbore, forming a closed fluid flow system extending from said wellbore surface through said drill string and returning through an annulus between said wellbore and said drill string back to said wellbore surface whereby fluids injected into said drill string at said wellbore surface travel into and out of said wellbore through a confined flow passage defined in part by said drill string and annulus, measuring the flow of the fluid injected through the drill string into said closed fluid flow system with said measuring instruments, measuring the flow of the fluid returning through said annulus from said closed fluid flow system with said measuring instruments, making a calibration comparison of the measured flow of the fluid injected into said closed fluid flow system with the measured flow of fluid returning from said closed fluid flow system, calibrating said measuring system as a function of the calibration comparison to form a calibrated measuring system, measuring, with said calibrated measuring system, the fluid injected into said drill string from the wellbore surface, measuring, with said calibrated measuring system, the fluid returning to the wellbore surface from said annulus, establishing, at a first subsurface wellbore location, a first formation parameter value associated with said formation, and correlating the calibration measurements of fluid with said first formation parameter value for determining a characteristic of said formation at said first subsurface wellbore location.

2. A method as defined in claim 1 wherein a rate of fluid flow is measured by said calibrated measuring system.

3. A method as defined in claim 1 wherein a temperature and pressure value are established at said first subsurface wellbore location.

4. A method as defined in claim 1 wherein multiple first formation parameter values established at different subsurface wellbore locations are correlated with associated calibrated surface injection fluid measurements and surface return fluid measurements to determine a range of the formation characteristics at different locations traversed by the wellbore.

5. A method as defined in claim 4 wherein said first formation parameter values are established using computer modeling.

6. A method as defined in claim 1 wherein said characteristic of said formation comprises permeability of said formation.

7. A method as defined in claim 1 wherein said first formation parameter value is established using a data resource.

8. A method as defined in claim 7 wherein said data resource comprises information from previously drilled wellbores into a same or similar formation.

9. A method as defined in claim 1 wherein said first formation parameter value is established using a pressure or temperature transducer located at said first subsurface wellbore location.

10. A method as defined in claim 1 wherein said first formation parameter value is measured and recorded in a logging instrument carried by said drill string in said wellbore.

11. A method as defined in claim 1 wherein said measuring system includes a quantitative analysis instrument to measure flow rate of fluids returning to said wellbore surface through said annulus.

12. A method as defined in claim 1 wherein said measuring system includes an ultrasonic gas measurement instrument for measuring a quantity of gas in a fluid returning to said wellbore surface through said annulus.

13. A method as defined in claim 1 wherein said measuring system employs a qualitative analysis instrument for measuring a composition of fluids returning to said wellbore surface through said annulus.

14. A method as defined in claim 11 wherein said qualitative analysis instrument comprises a chromatograph.

15. A method as defined in claim 1 further comprising adding a tracer to fluid injected into the drill string at the wellbore surface to assist in determining a fluid circulation rate through said closed fluid flow system.

16. A method as defined in claim 15 wherein said tracer comprises a neon gas.

17. A method as defined in claim 1 wherein said wellbore is drilled into said formation in overbalanced condition wherein the pressure in said formation is less than the pressure in a bottom of said wellbore.

18. A method as defined in claim 1 wherein said wellbore is drilled into said formation in underbalanced condition wherein the pressure in said formation is greater than the pressure in a bottom of said wellbore.

19. A method as defined in claim 1 wherein measurements from said calibrated measuring system are used to evaluate rate of fluid flow from said formation.

20. A method as defined in claim 1 wherein said calibrated measuring system transmits data representing measurements of temperature and pressure to the wellbore surface.

21. A method as defined in claim 1 wherein said well is constructed as a function of a determined characteristic of said formation.

22. A method as defined in claim 1 wherein a material balance determination is made to relate composition and volume of fluid injected into the well through the drill string with composition and volume of fluid returning to the wellbore surface through the annulus.

23. A method as defined in claim 22 further including separating fluids flowing from said annulus at said wellbore surface into constituent components.

24. A method as defined in claim 1 wherein said first formation parameter value is established using a fluid flow measuring instrument carried by said drill string in said wellbore.

25. A method as defined in claim 24 wherein said fluid flow measuring instrument comprises one or more of an acoustic, electromagnetic or capacitive transducer.

26. A method as defined in claim 24 wherein said fluid flow measuring instrument comprises a drill string carried instrument segment having multiple transducers for measuring variable parameters related to fluid flow through said wellbore.

27. A method as defined in claim 24 wherein said fluid flow measuring instrument comprises a drill string carried instrument segment having a fluid receiving recess defining a measurement containment area and having a measuring transducer for measuring a parameter of fluid contained in said measurement containment area.

28. A method as defined in claim 27 wherein said fluid flow measuring instrument is provided with multiple transducers for measuring a variable parameter related to fluid flow through said wellbore.

29. A method as defined in claim 28 wherein said multiple transducers include two or more transducers taken from a group consisting of acoustic, electromagnetic and capacitive transducers.

30. A method as defined in claim 29 wherein measurements from said fluid flow measuring instrument are compared with injection and return measurements of fluid flowing into and out of said wellbore.

31. A method as defined in claim 30 wherein a material balance determination is made to relate composition and volume of fluid injected into the wellbore through the drill string with composition and volume of the fluid returning to the well surface through the annulus.

32. A method as defined in claim 30 wherein said measuring system measures variable parameters within said wellbore to assist in evaluating permeability of said formation.

33. A method as defined in claim 30 wherein said wellbore is constructed as a function of a determined characteristic of said formation.

34. A method as defined in claim 24 wherein said first formation parameter value is established as said fluid flow measuring instrument is being rotated in said wellbore.

35. A method as defined in claim 24 wherein said fluid flow measuring instrument is carried by a stabilizing sub in stabilizing relationship with the drill bit.

36. A method as defined in claim 24 wherein said wellbore is drilled into said formation in underbalanced condition wherein the pressure in said formation is greater than the pressure in a bottom of said wellbore.

37. A method as defined in claim 24 wherein measurements from said fluid flow measuring instrument are compared with injection and return measurements of fluid flowing into and out of said wellbore.

38. A method as defined in claim 1 wherein one or more of a bottomhole temperature and a bottomhole pressure are used to determine the density or viscosity of fluid flowing from said formation into the wellbore.

39. A method as defined in claim 1 wherein an initial reservoir pressure of the formation is determined by terminating flow of fluids from said wellbore to allow the fluid pressure of fluids in said wellbore to rise to a value corresponding to the pressure of fluids in the formation.

40. A method as defined in claim 1 wherein a series of flows at different differential pressures between said wellbore and said formation are employed to extrapolate to an initial reservoir pressure of said formation.

41. A method as defined in claim 40 wherein an effective permeability for said formation is calculated using one or more of determined reservoir pressures and determined reservoir temperatures.

42. A method as defined in claim 41 wherein parameter measurements made in said wellbore are transmitted to the wellbore surface or are recorded in a subsurface recording instrument.

43. A method as defined in claim 1 wherein said measuring system is calibrated in a closed fluid flow system before said wellbore is extended into a productive reservoir formation.

44. A method as defined in claim 43 further comprising circulating a known quantity and density of fluid into said drill pipe and out of said annulus and calibrating measurement transducers in said system whereby a material balance situation exists in fluid circulating in said closed fluid flow system.

45. A method as defined in claim 44 wherein the following parameters are measured at a minimum of two different circulating fluid pressures in said drill string and annulus:

injection pressures, temperatures and flow rates;

wellbore bottom annulus pressures and temperatures;

annulus returned pressures, temperatures and flow rates; and hydrocarbon percentages measured over a period exceeding 1.1 wellbore circulation volumes.

46. A method as defined in claim 1 further comprising monitoring a circulation time for fluid to circulate from said wellbore surface through said drill string and return to said wellbore surface through said annulus.

47. A method as defined in claim 46 wherein said circulation time is monitored by utilizing a tracer in the fluid injected into said drill string at said wellbore surface and determining the time required for the tracer to return to the wellbore surface through the annulus.

48. A method as defined in claim 47 wherein said tracer comprises a carbide, an inert substance or a short half-life radioactive material.

49. A method as defined in claim 1 wherein a top of a reservoir in said formation is identified by a change in one or more of a wellbore bottomhole pressure, a wellbore bottomhole temperature, a hydrocarbon measurement in the annular fluid or a fluid flow rate through the drill pipe or annulus.

50. A method as defined in claim 49 wherein reservoir flow from a reservoir intersected by said wellbore is analyzed by relating varying annular back pressures at said wellbore surface with flow rates in said annulus.

51. A method as defined in claim 1 wherein said first formation parameter value is determined from computer modeling.

52. A method as defined in claim 1 further comprising determining the occurrence of a wellbore bottomhole pressure increasing to signal the occurrence of a kick during well construction.

53. A downhole tool for connection with a drill bit in a drill string for measuring a variable parameter in a wellbore while said wellbore is being constructed, comprising:

a longitudinally extending tool body having an internal passage for conveying fluid between first and second longitudinal ends of said tool body;

one or more longitudinally extending fluid recesses in said tool body external to said internal passage for receiving fluid to be measured, and energy transducers carried by said tool body for evaluating a fluid contained in said fluid recesses.

54. A downhole tool as defined in claim 53 wherein said energy transducers respond to the flow rate of fluid flowing through said one or more fluid recesses.

55. A downhole tool as defined in claim 53 wherein said energy transducers comprise one or more of acoustic transducers and electromagnetic induction transducers and electrical capacitance transducers.

56. A downhole tool as defined in claim 53 wherein said energy transducers comprise acoustic transducers and electromagnetic induction transducers.

57. A downhole tool as defined in claim 53 wherein said energy transducers comprise acoustic transducers and electromagnetic induction transducers and electrical capacitance transducers.

58. A downhole tool as defined in claim 53, wherein said tool body includes laterally and longitudinally extending, circumferentially spaced blades extending laterally away from said internal passage wherein at least one of said fluid recesses comprises a channel formed between adjacent blades and wherein said energy transducers comprise an energy transmitting transducer on a first blade and an energy receiving transducer on an adjacent second blade wherein energy transmission from said transmitting transducer travels along a path through a fluid in said channel to said receiving transducer to evaluate of said fluid traversed by said energy transmission while traveling along said path.

59. A downhole tool as defined in claim 58 wherein, one or more energy transmitting transducers are mounted on said first blade and multiple energy receiving transducers are mounted on said second blade, multiple energy transmissions between said one or more transmitting transducers and said multiple receiving transducers are responsive to a gas bubble entrained in a liquid comprising the fluid in said channel, and energy transmissions received by said energy receiving transducers have characteristics functionally related to travel along paths from said one or more transmitting transducers to said receiving transducers for determining a rate of axial flow of said gas bubble through said channel.

60. A downhole tool as defined in claim 59 wherein said one or more energy transmitting transducers and multiple energy receiving transducers comprise electromagnetic transducers.

61. A downhole tool as defined in claim 59 wherein said one or more energy transmitting transducers and multiple energy receiving transducers comprise acoustic transducers.

62. A downhole tool as defined in claim 59 wherein said one or more energy transmitting transducers and multiple energy receiving transducers comprise electromagnetic transducers and acoustic transducers.

63. A downhole tool as defined in claim 62 further comprising multiple electrical capacitance transducers.

64. A downhole tool as defined in claim 59 wherein said one or more energy transmitting transducers and said multiple energy receiving transducers are spaced longitudinally along said first and second blades.

65. A downhole tool as defined in claim 58 wherein said energy transducers obtain data to evaluate said fluid contained in said channel while said downhole tool is rotated in said wellbore.

66. A downhole tool as defined in claim 58 wherein said tool body is a stabilizer and said blades extend helically.

67. A downhole tool as defined in claim 53 further comprising one of a recording and a transmitting instrument for recording downhole in said wellbore or transmitting to a surface of said wellbore data derived by said energy transducers.

68. A downhole tool as defined in claim 53 further comprising electromagnetic transducers for measuring the conductivity of a fluid contained in said fluid receiving recesses.

69. A downhole tool as defined in claim 53 further comprising electrical capacitance transducers for determining an electrical capacitive characteristic between said capacitive transducers and the fluid contained in the fluid receiving recesses.

70. A downhole tool as defined in claim 53 wherein said energy transducers are situated to evaluate said fluid contained in said one or more fluid recesses while said downhole tool is rotated within said wellbore.

71. A downhole tool as defined in claim 53 wherein said first longitudinal end of said tool body connects with a drill string extending to a surface of said wellbore and said second longitudinal end of said tool body connects with a drill bit.

72. A system having a bottomhole measuring instrument secured to a drill string and bit for detecting a kick in a wellbore of a well being drilled into a subsurface formation, comprising:

a bottomhole measuring instrument having an axially extending tool body and a central, axially developed passage for conveying fluid between first and second axial ends of said tool body, radially and axially extending, circumferentially spaced blades carried on an external surface of said tool body, fluid receiving recesses defined between said circumferentially spaced blades for receiving fluid located in an area intermediate said external surface of said tool body and the wellbore, energy transducers carried by said blades for evaluating fluid contained in said fluid receiving recesses, and a kick signaling system responsive to said transducer to evaluate said fluid contained in said fluid receiving recesses for signaling the occurrence of a kick in said well.

73. A system as defined in claim 72 wherein said energy transducers are responsive to at least one of the flow rate and composition of fluid flowing through said fluid receiving recesses.

74. A system as defined in claim 72 wherein said energy transducers comprise acoustic transducers or electromagnetic transducers or electrical capacitance transducers.

75. A system as defined in claim 72 wherein said energy transducers comprise an energy transmitting transducer on a first blade and one or more energy receiving transducers on an adjacent second blade whereby energy transmission from said energy transmitting transducer travels along one or more paths through a fluid receiving recess to said energy receiving transducer to evaluate a fluid traversed by said energy transmission while traveling along said one or more paths.

76. A system as defined in claim 75 wherein, one or more energy transmitting transducers are mounted on said first blade and multiple energy receiving transducers are mounted on said second blade, multiple energy transmissions between said one or more transmitting transducers and said multiple receiving transducers are responsive to a gas bubble entrained in a liquid comprising the fluid in one of said fluid receiving recesses, and energy transmissions received by said energy receiving transducers have characteristics functionally related to travel of energy transmissions along said paths from said one or more transmitting transducers to said receiving transducers for use in a time based calculation to determine a rate of axial flow of said gas bubble through one of said fluid receiving recesses.

77. A system as defined in claim 76 comprising a kick indication sign to signal a kick when a fluid flow from said formation into said wellbore is detected by said energy transducers.

78. A method for evaluating a subsurface formation traversed by a wellbore constructed from a well surface with a drill bit carried at the end of a drill string, comprising:

establishing a measuring system for measuring a fluid injection rate of fluid injected into the drill string from the well surface, taking a first measurement of the rate of fluid flow between said wellbore and said formation with a subsurface flow measurement tool carried on the drill string, determining a first location within said wellbore where said first rate of fluid flow is measured, determining the fluid injection rate while said first measurement is taken, deepening said borehole with said drill bit, taking a second measurement of the rate of fluid flow between said wellbore and said formation with said subsurface flow measurement tool, determining a second location within said wellbore where said second rate of fluid flow is measured, determining the fluid injection rate while said second measurement is taken, and correlating the fluid injection rates into the drill string and the locations within said wellbore where said measurements are taken to determine a permeability change between said first and second locations.

79. A method as defined in claim 78 further comprising altering construction of said wellbore as a function of said permeability change.

80. A method as defined in claim 78 further comprising performing multiple correlations at multiple locations within said wellbore to produce a profile relating permeability and wellbore depths along a substantial length of said formation.

81. A method as defined in claim 78 further comprising measuring fluids returning to said well surface from said wellbore.

82. A method as defined in claim 78 wherein pressure in said formation is greater than pressure in said wellbore whereby fluid flows from said formation into said wellbore.

83. A method as defined in claim 78 wherein pressure in said formation is less than pressure in said wellbore whereby fluid flows from said wellbore into said formation.

84. A method as defined in claim 80 further comprising measuring fluids returning to said well surface from said wellbore.

85. A method as defined in claim 84 further comprising altering construction of said wellbore as a function of said permeability change.

86. A method as defined in claim 78 further comprising:

conveying said fluid through an internal passage between first and second longitudinal ends of a tool body;

providing one or more longitudinally extending fluid recesses in said tool body external to said internal passage for receiving fluid to be measured, and carrying energy transducers by said tool body for evaluating a fluid contained in said fluid recesses.

87. A method as defined in claim 86 further comprising positioning said energy transducers to respond to the flow rate of fluid flowing through said channel.

88. A method as defined in claim 86 further comprising positioning one or more of acoustic transducers and electromagnetic induction transducers and electrical capacitance transducers on said tool body.

89. A method as defined in claim 86, further providing laterally and longitudinally extending, circumferentially spaced blades extending laterally away from said internal passage wherein at least one of said fluid recesses comprises a channel formed between adjacent blades.

90. A method as defined in a claim 89, further comprising placing an energy transmitting transducer on one blade and an energy receiving transducer on an adjacent blade wherein energy transmission from said transmitting transducer travels along a path through a fluid in said channel to said receiving transducer to permit evaluation of said fluid traversed by said energy transmission while traveling along said path.

91. A method as defined in claim 90 further comprising, mounting, one or more energy transmitting transducers on said one blade and multiple energy receiving transducers on said adjacent blade, sensing a gas bubble entrained in a liquid comprising a fluid in said channel with multiple energy transmissions between said one or more transmitting transducers and said multiple receiving transducers, and functionally relating energy transmissions along paths from said one or more transmitting transducers to said receiving transducers for determining a rate of axial flow of said gas bubble through said channel.

* * * * *